US007540622B1

(12) United States Patent
Bechtol

(10) Patent No.: US 7,540,622 B1
(45) Date of Patent: Jun. 2, 2009

(54) TREE ORNAMENT

(76) Inventor: Bryan F. Bechtol, 4400 Diamond Ave., Mobile, AL (US) 36619

( * ) Notice: Subject to any disclaimer, the term of this patent is extended or adjusted under 35 U.S.C. 154(b) by 187 days.

(21) Appl. No.: 11/620,133

(22) Filed: Jan. 5, 2007

(51) Int. Cl.
*F21V 21/30* (2006.01)

(52) U.S. Cl. ..... 362/35; 362/121; 362/252; 362/568; 40/431

(58) Field of Classification Search ..... 362/35, 362/121, 565, 566, 567, 568, 122, 123, 135, 362/140, 249, 252, 253, 806; 40/431, 430, 40/432, 434, 435
See application file for complete search history.

(56) References Cited

U.S. PATENT DOCUMENTS

| | | | | | |
|---|---|---|---|---|---|
| 1,541,687 | A * | 6/1925 | Cory | 40/431 |
| 1,747,556 | A * | 2/1930 | Price | 40/431 |
| 1,940,500 | A * | 12/1933 | Lawrence | 40/432 |
| 2,059,653 | A * | 11/1936 | Pretzfelder | 362/121 |
| 2,629,044 | A * | 2/1953 | Marfisi | 40/431 |
| 4,008,534 | A * | 2/1977 | Swartz | 40/431 |
| 4,214,296 | A * | 7/1980 | Magett | 362/35 |
| 4,250,537 | A * | 2/1981 | Roegner et al. | 362/86 |
| 4,764,850 | A * | 8/1988 | Albanese | 362/35 |
| 4,980,608 | A | 12/1990 | Morrison | |
| D326,639 | S | 6/1992 | Morrison | |
| 5,280,682 | A | 1/1994 | Fussell | |
| 5,455,750 | A * | 10/1995 | Davis et al. | 362/123 |
| D428,185 | S | 7/2000 | Lau | |
| 6,145,228 | A * | 11/2000 | LaChance | 40/431 |
| 6,494,591 | B1 * | 12/2002 | Guimond | 362/249 |
| 6,592,423 | B1 * | 7/2003 | Boyle et al. | 446/175 |
| 6,793,355 | B1 | 9/2004 | Leung | |
| 7,334,913 | B1 * | 2/2008 | Chen | 362/186 |
| 7,380,956 | B2 * | 6/2008 | Richmond et al. | 362/123 |
| 2005/0231975 | A1 * | 10/2005 | Bixler et al. | 362/565 |

* cited by examiner

*Primary Examiner*—Sandra L. O'Shea
*Assistant Examiner*—Gunyoung T. Lee

(57) ABSTRACT

A tree ornament for being positioned on top of a tree to decorate the tree includes a base being configured to be mounted on a top of the tree. A centerpiece includes a reflective surface to reflect light off of the centerpiece. The centerpiece is mounted to the base. A support ring is coupled to the base. The support ring extends upwardly from the base and is positioned around the centerpiece. Each of a plurality of light assemblies is coupled to the support ring and arranged around the centerpiece. Each of the light assemblies is electrically coupled to a power supply. The light assemblies emit light towards the centerpiece to be reflected off of the centerpiece when the light assemblies are provided power by the power supply.

11 Claims, 4 Drawing Sheets

TREE ORNAMENT

BACKGROUND OF THE INVENTION

1. Field of the Invention

The present invention relates to mirror balls and more particularly pertains to a new mirror ball for being positioned on top of a tree to decorate the tree.

2. Description of the Prior Art

The use of mirror balls is known in the prior art. While these devices fulfill their respective, particular objectives and requirements, the need remains for a system that has certain improved features that allows light directed onto a centerpiece of the system to be reflected into an area adjacent a tree that the system is positioned on. Additionally, the system should include lenses to change the color of the light illuminating the centerpiece.

SUMMARY OF THE INVENTION

The present invention meets the needs presented above by generally comprising a base being configured to be mounted on a top of the tree. A centerpiece includes a reflective surface to reflect light off of the centerpiece. The centerpiece is mounted to the base. A support ring is coupled to the base. The support ring extends upwardly from the base and is positioned around the centerpiece. Each of a plurality of light assemblies is coupled to the support ring and arranged around the centerpiece. Each of the light assemblies is electrically coupled to a power supply. The light assemblies emit light towards the centerpiece to be reflected off of the centerpiece when the light assemblies are provided power by the power supply.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
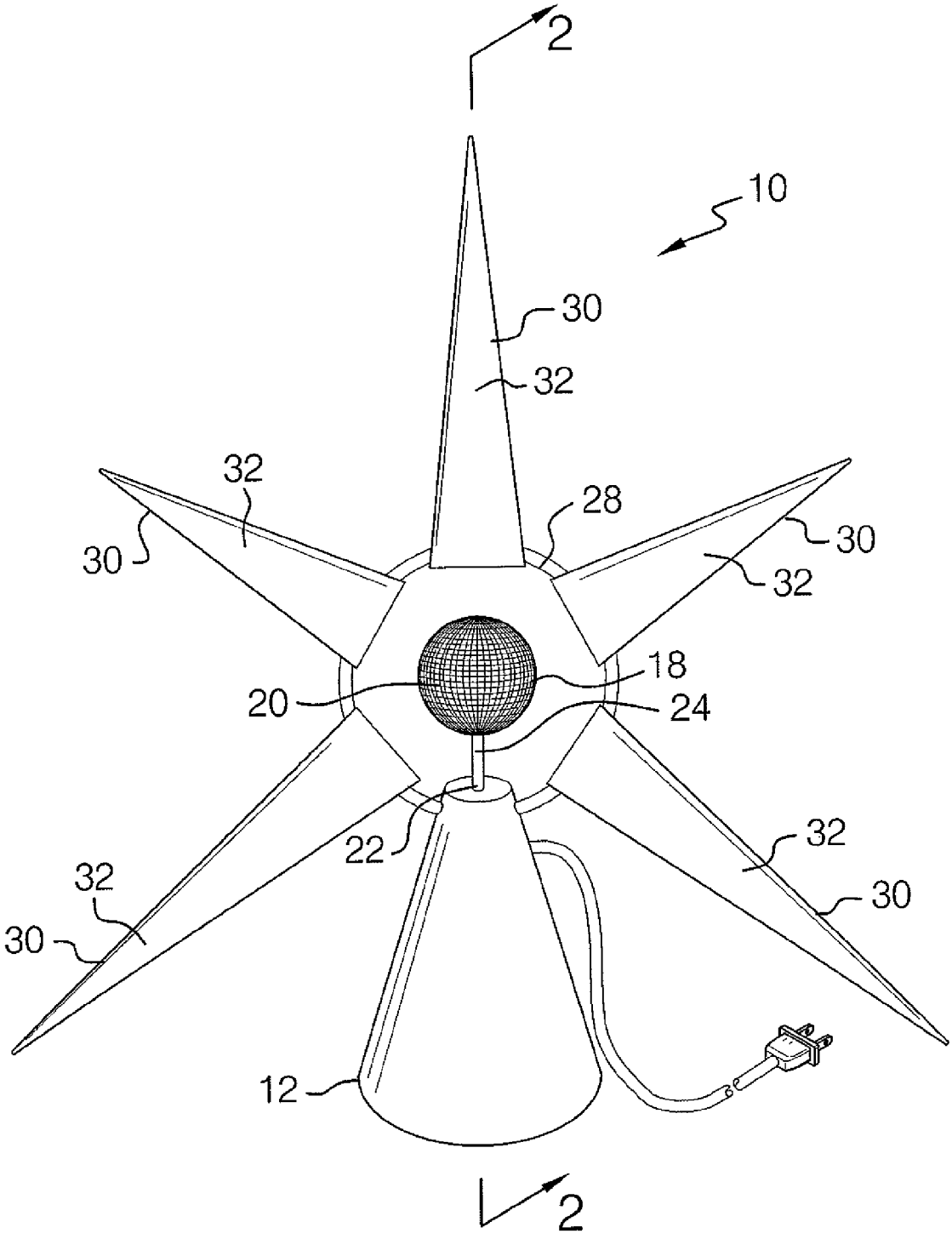
FIG. 1 is a front perspective view of a tree ornament according to the present invention.
Figure 2:
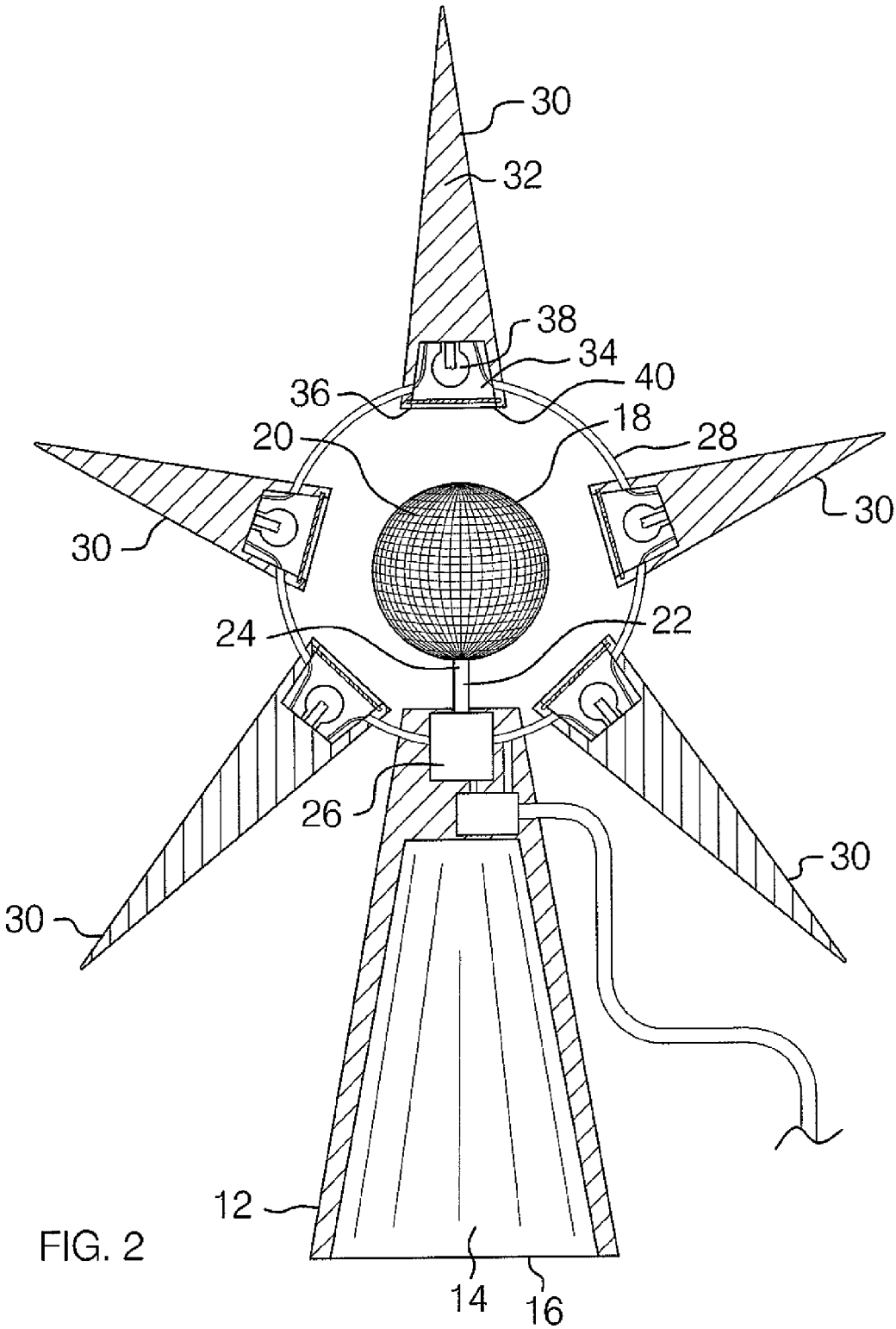
FIG. 2 is a cross-sectional view of the present invention taken along line 2-2 of FIG. 1.
Figure 3:
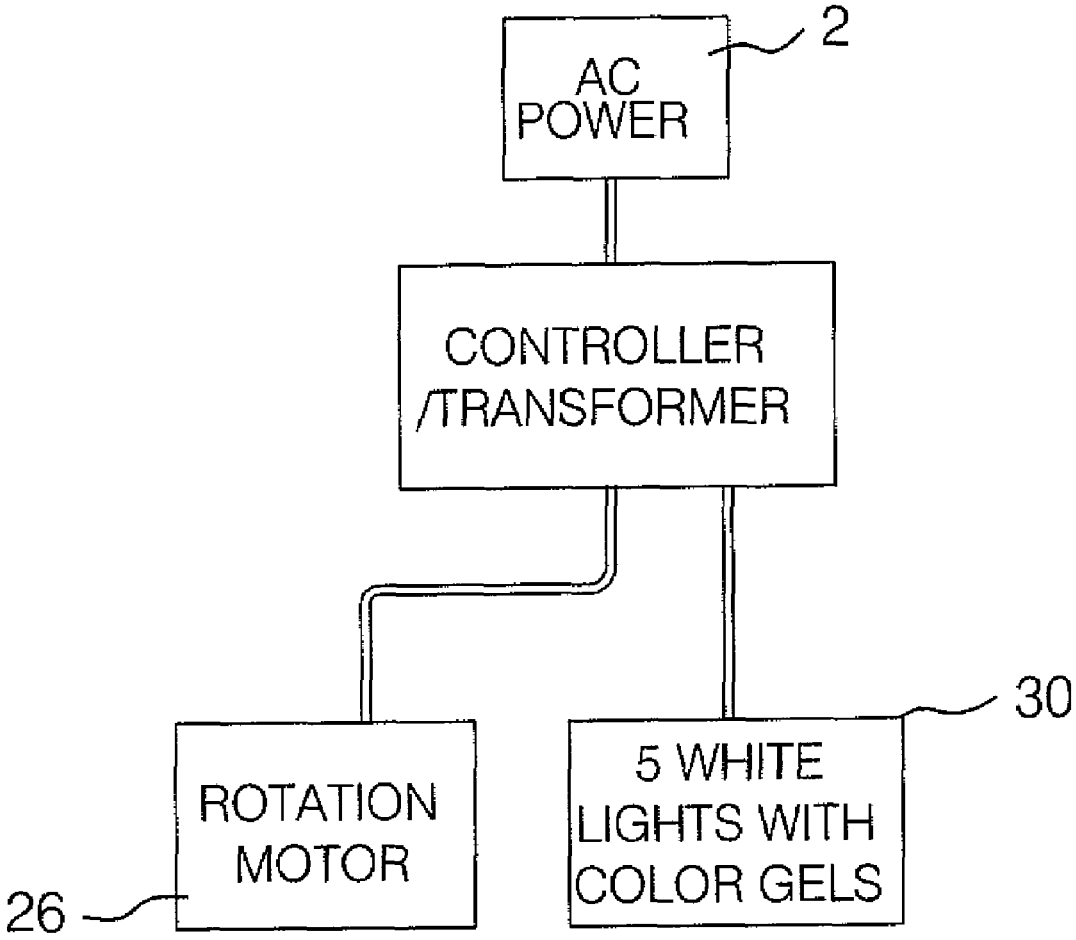
FIG. 3 is a schematic view of the present invention.
Figure 4:
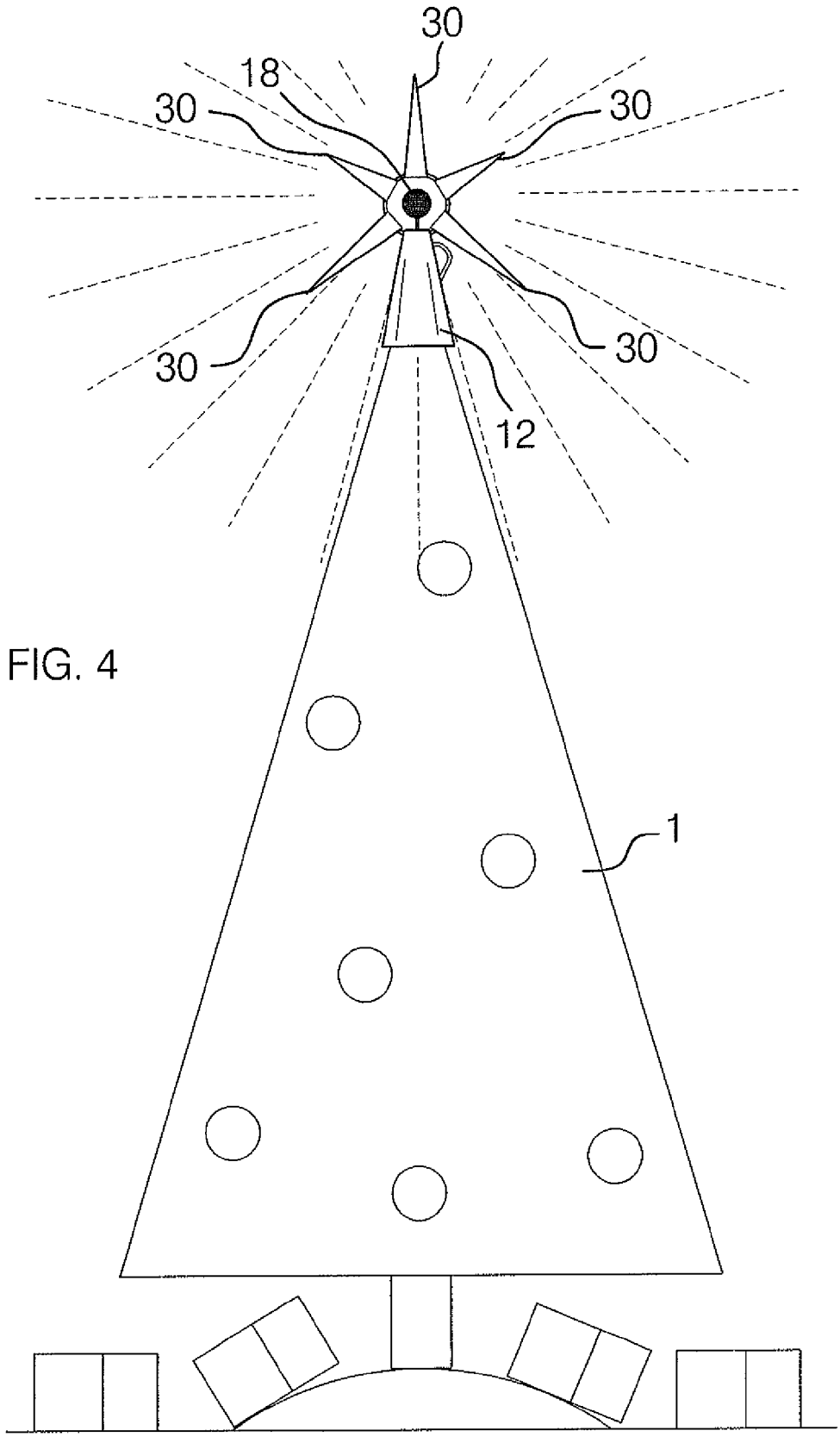
FIG. 4 is a front view of the present invention shown in use.

With reference now to the drawings, and in particular to FIGS. 1 through 4 thereof, a new mirror ball embodying the principles and concepts of the present invention and generally designated by the reference numeral 10 will be described.

As best illustrated in FIGS. 1 through 4, the tree ornament 10 generally comprises a base 12 being configured to be mounted on top of a tree 1. The base 12 is approximately frusto-conical shaped. The base 12 has a cavity 14 extending into the base 12 through a bottom face 16 of the base 12. The cavity 14 receives a top portion of the tree 1 to mount the base 12 on top of the tree 1.

A centerpiece 18 includes a reflective surface 20 to reflect light off of the centerpiece 18. The centerpiece 18 is ball shaped and includes a plurality of adjoined planar surfaces. Each of the planar surfaces can also have a variety of shapes including, but not limited to, an angel, a star or a Santa to change the shape of the reflections cast off by the centerpiece 18. An axle 22 is rotatably coupled to the base 12. The axle 22 has an upper end 24 attached to the centerpiece 18.

A motor 26 is coupled to the base 12. The motor 26 is electrically coupled to a power supply 2. The motor 26 is mechanically coupled to the axle 22 to rotate the axle 22 and the centerpiece 18 with respect to the base 12 when the motor 26 is supplied with power from the power supply 2. The motor 26 is positioned within the base 12.

A support ring 28 is coupled to the base 12. The support ring 28 extends upwardly from the base 12 and is positioned around the centerpiece 18. The support ring 28 is coplanar with a longitudinal axis of the axle 22. Each of a plurality of light assemblies 30 is coupled to the support ring 28 and arranged around the centerpiece 18. Each of the light assemblies 30 is electrically coupled to the power supply 2. The light assemblies 30 emit light towards the centerpiece 18 to be reflected off of the centerpiece 18 when the light assemblies 30 are provided power by the power supply 2.

Each of the light assemblies 30 includes a housing 32 coupled to the support ring 28. The housing 32 has a recess 34 extending therein through an interior face 36 of the housing 32. The housing 32 is approximately cone shaped. A light emitter 38 is coupled to the housing 32. The light emitter 38 is positioned in the recess 34 of the housing 32. The light emitter 38 is electrically coupled to the power supply 2. The light emitter 38 emits light toward the centerpiece 18 when the light emitter 38 is supplied power from the power supply 2. A lens 40 is coupled to the housing 32 and extends across the recess 34. The lens 40 is positioned between the light emitter 38 and the centerpiece 18. The lens 40 of each of the light assemblies 30 has a unique color to change the color of light emitted from the light emitter 38 illuminating the centerpiece 18.

In use, the top of the tree 1 is inserted into the cavity 14 of the base 12 to position the base 12 on top of the tree 1. The motor 26 is then electrically coupled to the power supply 2. The motor 26 rotates the centerpiece 18 above the base 12. The light assemblies 30 emit light onto the centerpiece 18 to illuminate the centerpiece 18 and the reflective surface 20 of the centerpiece 18 reflects the light from the light assemblies 30 into an area adjacent the tree 1.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tree ornament for positioned on top of a tree, said ornament comprising:

a base being configured to be mounted on a top of the tree;

a centerpiece including a reflective surface to reflect light off of said centerpiece, said centerpiece being mounted to said base;

a support ring being coupled to said base; said support ring extending upwardly from said base and positioned around said centerpiece; and a plurality of light assemblies being coupled to said support ring and arranged around said centerpiece, each of said light assemblies being electrically coupled to a power supply, said light assemblies emitting light towards said centerpiece to be reflected off of said centerpiece when said light assemblies are provided power by the power supply, each of said light assemblies including:

a housing being coupled to said support ring, said housing having a recess extending therein through an interior face of said housing;

a light emitter being coupled to said housing, said light emitter being positioned in said recess of said housing, said light emitter being electrically coupled to the power supply, said light emitter emitting light toward said centerpiece when said light emitter is supplied power from the power supply; and a lens being coupled to said housing and extending across said recess, said lens being positioned between said light emitter and said centerpiece;

said lens of each of said light assemblies having a unique color to change the color of light emitted from said light emitter illuminating said centerpiece.

2. The ornament according to claim 1, wherein said base is approximately frusto-conical shaped.

3. The ornament according to claim 1, wherein said base has a cavity extending into said base through a bottom face of said base, said cavity receiving a top portion of the tree to mount said base on top of the tree.

4. The ornament according to claim 1, wherein said centerpiece is ball shaped and including a plurality of adjoined planar surfaces.

5. The ornament according to claim 1, further comprising an axle being rotatably coupled to said base, said axle having an upper end attached to said centerpiece.

6. The ornament according to claim 5, further comprising a motor being coupled to said base, said motor being electrically coupled to the power supply, said motor being mechanically coupled to said axle to rotate said axle and said centerpiece with respect to said base when said motor is supplied with power from the power supply.

7. The ornament according to claim 6, wherein said motor is positioned within said base.

8. The ornament according to claim 1, wherein said support ring is coplanar with a longitudinal axis of said axle.

9. The ornament according to claim 1, wherein each of said light assemblies includes.

10. The ornament according to claim 1, wherein said housing is approximately cone shaped.

11. A tree ornament for positioned on top of a tree, said ornament comprising:

a base being configured to be mounted on a top of the tree, said base being approximately frusto-conical shaped, said base having a cavity extending into said base through a bottom face of said base, said cavity receiving a top portion of the tree to mount said base on top of the tree;

a centerpiece including a reflective surface to reflect light off of said centerpiece, said centerpiece being ball shaped and including a plurality of adjoined planar surfaces;

an axle being rotatably coupled to said base, said axle having an upper end attached to said centerpiece;

a motor being coupled to said base, said motor being electrically coupled to a power supply, said motor being mechanically coupled to said axle to rotate said axle and said centerpiece with respect to said base when said motor is supplied with power from the power supply, said motor being positioned within said base;

a support ring being coupled to said base, said support ring extending upwardly from said base and positioned around said centerpiece, said support ring being coplanar with a longitudinal axis of said axle;

a plurality of light assemblies being coupled to said support ring and arranged around said centerpiece, each of said light assemblies being electrically coupled to the power supply, said light assemblies emitting light towards said centerpiece to be reflected off of said centerpiece when said light assemblies are provided power by the power supply, each of said light assemblies comprising:

a housing being coupled to said support ring, said housing having a recess extending therein through an interior face of said housing, said housing being approximately cone shaped;

a light emitter being coupled to said housing, said light emitter being positioned in said recess of said housing, said light emitter being electrically coupled to the power supply, said light emitter emitting light toward said centerpiece when said light emitter is supplied power from the power supply; and a lens being coupled to said housing and extending across said recess, said lens being positioned between said light emitter and said centerpiece, said lens of each of said light assemblies having a unique color to change the color of light emitted from said light emitter illuminating said centerpiece.

* * * * *